US006997324B2

(12) United States Patent
Hirschel et al.

(10) Patent No.: US 6,997,324 B2
(45) Date of Patent: Feb. 14, 2006

(54) ANTI-THEFT PRODUCT DISPLAY DEVICE

(75) Inventors: Sanford D Hirschel, San Carlos, CA (US); Cody D Railey, Durham, NC (US)

(73) Assignee: Intuit, Inc., Mountain View, CA (US)

( * ) Notice: Subject to any disclaimer, the term of this patent is extended or adjusted under 35 U.S.C. 154(b) by 0 days.

(21) Appl. No.: 10/831,730

(22) Filed: Apr. 22, 2004

(65) Prior Publication Data

US 2004/0211680 A1 Oct. 28, 2004

Related U.S. Application Data

(60) Provisional application No. 60/465,280, filed on Apr. 23, 2003.

(51) Int. Cl.
*B65D 5/50* (2006.01)

(52) U.S. Cl. ..... 206/763; 206/775

(58) Field of Classification Search ..... 206/736, 206/752, 756, 763, 232, 769, 772, 773, 774, 206/223, 229, 759, 775–777, 779, 782, 493
See application file for complete search history.

(56) References Cited

U.S. PATENT DOCUMENTS 1,689,637 A * 10/1928 Mordecai ..... 281/15.1
3,819,043 A * 6/1974 Harrison ..... 206/449
4,127,228 A * 11/1978 Hall ..... 229/117.16
4,713,899 A 12/1987 Fast
4,869,364 A 9/1989 Bray
4,951,404 A * 8/1990 Lithwick ..... 40/124.06
5,439,104 A * 8/1995 Wolska-Klis ..... 206/233
5,555,991 A 9/1996 Hart
5,775,494 A * 7/1998 Taplin ..... 206/308.2
6,202,838 B1 3/2001 Tran
6,230,964 B1 * 5/2001 Saito ..... 229/92.8
D446,713 S 8/2001 Adam
D460,301 S * 7/2002 Milliorn ..... D6/515
6,478,154 B2 11/2002 Cliff et al.
6,634,125 B2 10/2003 Abramson et al.
6,676,584 B2 * 1/2004 Tachikawa et al. ..... 493/70

OTHER PUBLICATIONS

International Search Report, PCT/US04/12638, Jan. 14, 2005.

* cited by examiner

*Primary Examiner*—Shian T. Luong
(74) *Attorney, Agent, or Firm*—Fenwick & West LLP

(57) ABSTRACT

A display enclosure encloses a retail software product box that has a cover attached to the box to display information about the product. The display enclosure has an aperture on its top surface. The aperture is shaped in such a way as to prevent the product box from being removed from the enclosure through the aperture. When the product box is enclosed within the display enclosure, the cover and preferably additional pages are passed through the aperture and extend outside of the display enclosure for the purchaser to read.

16 Claims, 12 Drawing Sheets

ANTI-THEFT PRODUCT DISPLAY DEVICE

CROSS-REFERENCE TO RELATED APPLICATION

This application claims the benefit under 35 U.S.C. § 119(e) of U.S. Provisional Application No. 60/465,280, filed on Apr. 23, 2003 and entitled "Anti-Theft Product Display Device," which disclosure is incorporated by reference herein.

BACKGROUND OF THE INVENTION

1. Field of the Invention

This invention relates generally to an anti-theft product display device for enclosing a retail product box, and more particularly to an anti-theft product display device for enclosing a retail software product box that allows purchasers to have access to product information attached to the product box.

2. Background Art

As with all other types of products, software products require effective product marketing to obtain significant sales. One primary location for product marketing is directly on the product box itself, where the purchaser can read about the features and capabilities of the product while browsing products in the retail store. Software manufacturers know that they have only a limited amount of space on the product box (e.g., the six exterior sides of a conventional box) to provide useful product information, and thus limited amount of time for holding the attention of the purchaser. In order to provide more room for product information that can be read by the purchaser, and thus increase the likelihood of the purchaser buying the product, many manufacturers now use a product box that has multiple product information pages attached to the front of the box below a cover.

FIG. 1 shows this type of product box 100 that is used for storing a software product and displaying documentation about the product. The box 100 has a cover 110 and a body section 120. The body section 120 of the box 100 has six surfaces: the top 125, the bottom (not shown), and four side surfaces. Only the top surface 125 and two side surfaces 150 and 160 are shown in FIG. 1. Each surface of the box 100 is normally used to display information about the product. It should be understood that the box 100 can be of any shape, such as trapezoidal, triangular, etc.

To increase the amount of product information that is provided to the purchaser, the cover 110 is attached along one edge of the top surface 125 of the body section 120. The cover 110 opens and closes over the top surface 125, like the cover of a book. The cover 110 has an inside surface 140 and an outside surface (not shown). Both the inside surface 140 and the outside surface of the cover 110 are used to display product information, but as is clear, this requires the purchaser to be able to open the cover 110 in order to view this information. In most instances there are a number of additional inside product information pages 115 attached between the cover 110 and the top surface 125. These pages 115 also provide further product information, including text and graphics. The more information the manufacturer can provide, the more likely the purchaser is to find features of the product that are interesting, and hence the more likely the purchaser is to buy the software product. As can be appreciated then from the figure, the inside pages 115, the top surface 125, and the inside surface 140 of the cover 110 can only be viewed when the cover 110 is opened.

Retail theft of software product is a substantial problem. Most thieves steal the software product by cutting open the product box and removing the CD-ROM containing the software. Other thieves simply abscond from the store with the entire product box. Manufacturers attempt to deter this type of theft by encasing the software product box (such as shown in FIG. 1) in a bulky, sealed, clear, tough plastic box, conventionally known as a "clamshell" box. The product box is encased in the clamshell during manufacturing. The clamshell cannot be opened without effectively destroying it. This deters the thief from attempting to either hide the product box, or cut open the product box to remove the CD-ROM.

This proposed solution has a number of drawbacks. Chief among them is that the sealed plastic box prevents purchasers from opening the cover 110 and reading the product information on the inside pages 115 and top surface 125 of the product box 100 and on the inside surface 140 of the cover 110. Thus, while the sealed clamshell maybe useful for deterring theft, it completely undermines the marketing effectiveness of the cover 110 and inside product pages 115.

Therefore, there is a need for a device that maintains security protection of a clamshell type product enclosure, while not interfering with the features of the product display box that provide additional product information to the purchaser.

SUMMARY OF THE INVENTION

A display enclosure for a retail software product box has a lid and a base, which are adapted to be joined together. The lid has a top surface, left, right, and bottom edges, and is adapted to form the top surface of the display enclosure. The lid has an aperture on its top surface. A software (or any other type of good) product box has a cover attached to a top surface of the box for displaying information about the product. The product box optionally includes inside pages between the cover and the top surface of the box for providing additional marketing information.

The product box can be placed in the base of the display enclosure. Then, the lid is placed onto the base so that the cover of the product box and preferably the product pages fit through the aperture of the lid and extend outside of the display enclosure. The lid is then sealed to the base. Because the cover and product pages now extend outside of the display enclosure, a prospective purchaser is still able to open the cover and view the inside of the cover, all of the inside pages, and the top surface of the product box. The cover can also be closed over the top surface of the lid. The lid may also include an opening through which the cover of the product box may connect to the top surface of the product box in order to secure it in the closed position.

Generally, the aperture of the lid is shaped in such a way as to allow the cover and inside pages to extend outside of the display enclosure and at the same time to prevent the product box from being removed from the display enclosure through the aperture. The aperture can be of any shape, such as semicircular, triangular, rectangular, etc. The aperture can be shaped as a slot running along a hinged edge of the lid. Similarly, the inside pages can be of any shape. For example, the inside pages can have the same shape as the aperture, but slightly smaller. Alternatively, the shape of the inside pages can be different from the shape of the aperture.

The display enclosure thus operates to deter shoplifting by providing the same benefits as existing clamshell boxes (e.g., protection of the product box from opening or tampering), while also allowing the manufacturer to provide any amount of desired product marketing through the use of the cover and inside product pages.

The figures depict an embodiment of the present invention for purposes of illustration only. One skilled in the art will readily recognize from the following description that alternative embodiments of the structures and methods illustrated herein may be employed without departing from the principles of the invention described herein.

DETAILED DESCRIPTION OF THE PREFERRED EMBODIMENTS

Figure 1:
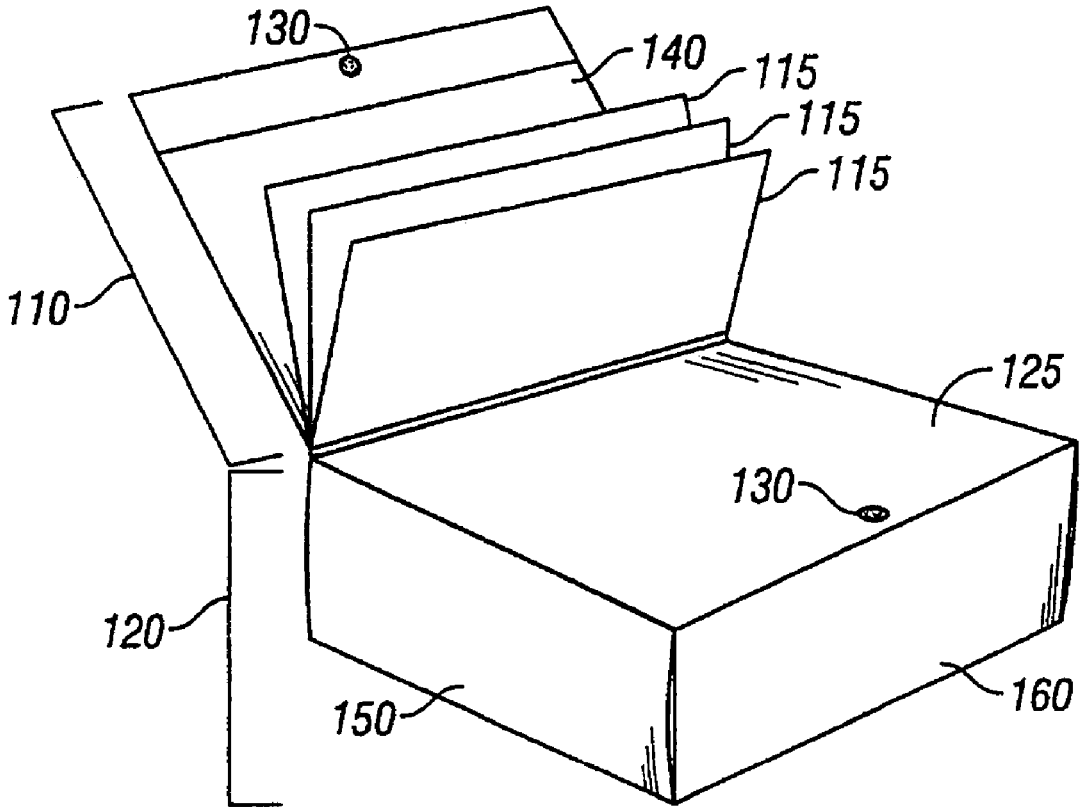
FIG. 1 (Prior Art)
FIG. 1 shows a perspective view of a prior art software product box.
Figure 2:
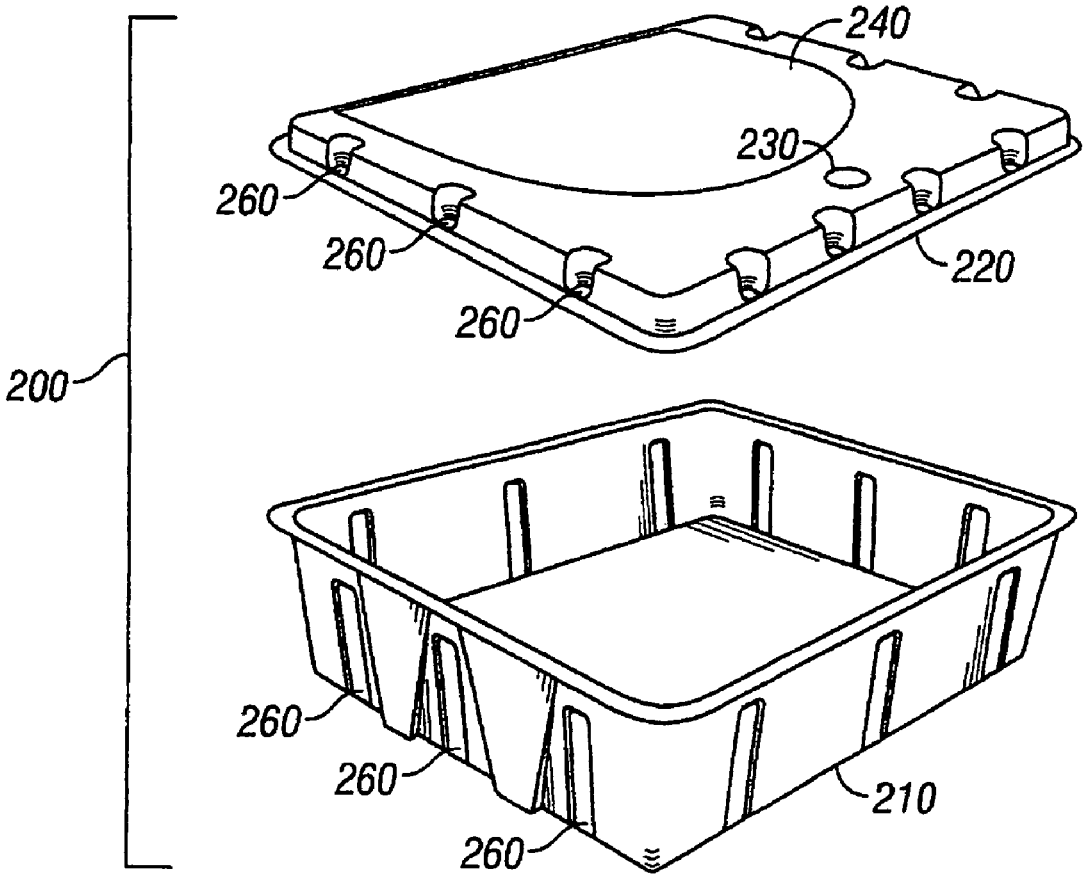
FIG. 2 shows an exploded, perspective view of a display enclosure in accordance with one embodiment of the invention.

FIG. 2 shows a display enclosure 200 adapted to enclose the body section 120 of a product box 100, such as shown in FIG. 1. In its most simple embodiment, the display enclosure 200 comprises a base 210 and a lid 220. The base 210 is shaped in such a way as to receive the body section 120 of the product box 100. The display enclosure 200 is preferably transparent, so that product information printed on the surface of the product box 100 can be easily read. However, the display enclosure 200 may alternatively be partially or entirely opaque and itself be printed over with product information.

The display enclosure 200 has an aperture 240 on a top surface of the lid 220. The aperture 240 is shaped in such a way as to allow the cover 110 (such as shown in FIG. 1) to pass through and extend outside of the display enclosure 200. The aperture 240 can be of any shape, such as semicircular, triangular, rectangular, square, slot etc. The aperture 240 shown in FIG. 2, for example, has a semicircular shape. The aperture 240 shown in FIG. 6 is shaped as a slot. The aperture 240 could be just wide enough to allow the cover 110 and display pages to fit through and only just narrow enough to prevent the product box from being removed from the display enclosure 200 through the aperture 240. FIGS. 5A–5D show various shapes of the aperture 240.

The lid 220 and the base 210 of the display enclosure 200 may be sealed together using conventional heat-sealing, adhesive, radio frequency, or other techniques. The lid 220 and the base 210 may be formed using conventional thermoforming methods and materials.

Many product boxes (such as the one shown in FIG. 1) that include cover 110 (with or without inside pages 115) include a mechanism 130 to lock the cover 110 to the box to prevent it from flapping about when the box is picked up and moved. The locking mechanism 130 may include, for example, two complimentary connectors which mate when the cover is closed. Generally, one connector is attached to the top surface 125, and the other connector is attached to the inside surface 140 of the cover 110, and they are aligned so that they meet when the cover 110 is closed. The locking mechanism 130 can be any mechanism for locking the cover 110 when in a closed position, such as VELCRO®, buttons, fasteners, etc.

In a preferred embodiment then for these types of product boxes, the lid 220 of the display enclosure 200 includes an opening 230 that allows the two connectors of the locking mechanism 130 to meet. This enables the cover 110 to remain closed after the product box 100 is sealed within the display enclosure 200. This feature enables the display enclosure 200 to be used with an existing inventory of product boxes 100 that have locking mechanism 130 and that may have been created and manufactured prior to the manufacturing of the display enclosure 200.

Figure 3:
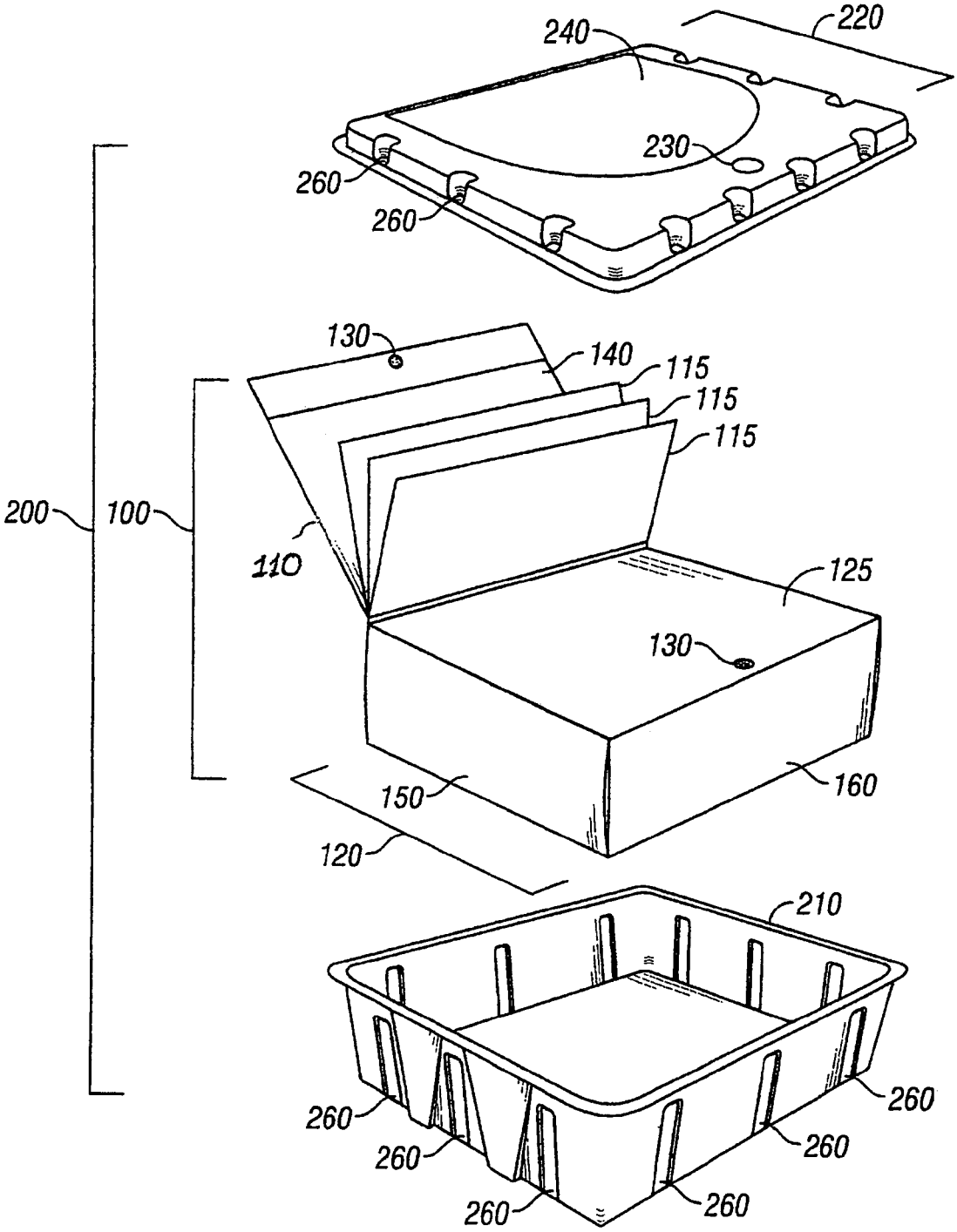
FIG. 3 shows an exploded, assembly view showing the lid and base of the display enclosure in conjunction with a product box.

FIG. 3 is an exploded, assembly view showing the display enclosure 200 in conjunction with the product box 100. To assemble the display enclosure 200, the body section 120 of the box 100 is placed within the base 210. Then, the lid 220 is placed onto the base 210 so that the cover 110 and preferably the inside pages 115 pass through the aperture 240 and extend outside of the display enclosure 200 as will be shown in FIGS. 4A and 4B. The display enclosure 200 is then sealed around the body section 120 of the box 100.

Figure 4A:
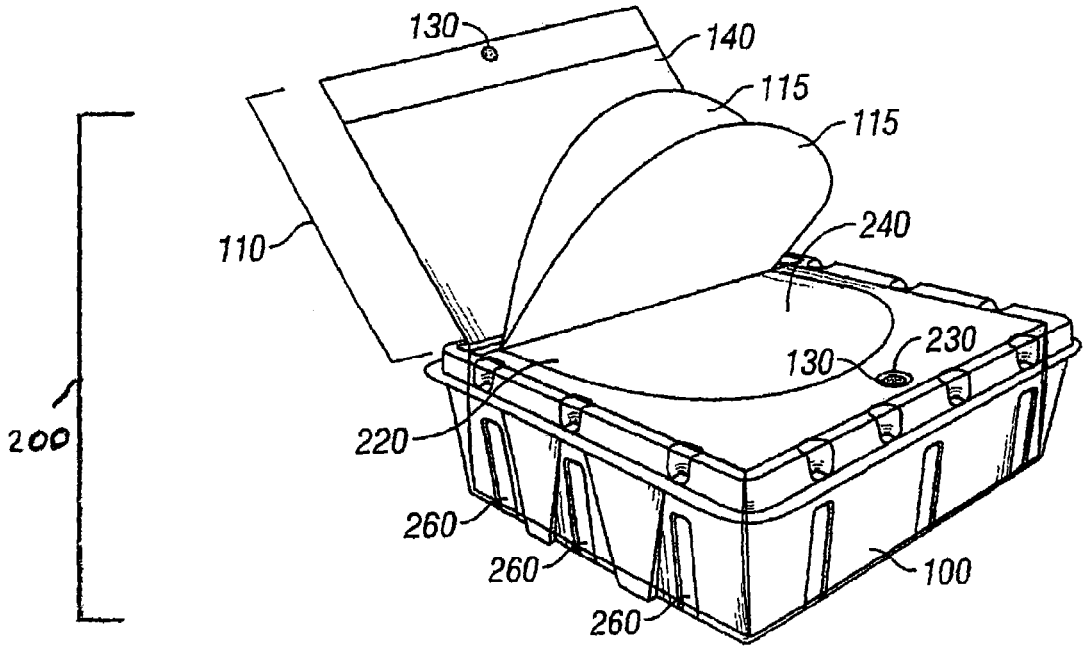
FIGS. 4A and 4B show the assembled display enclosure containing a product box with its cover opened.
Figure 4B:
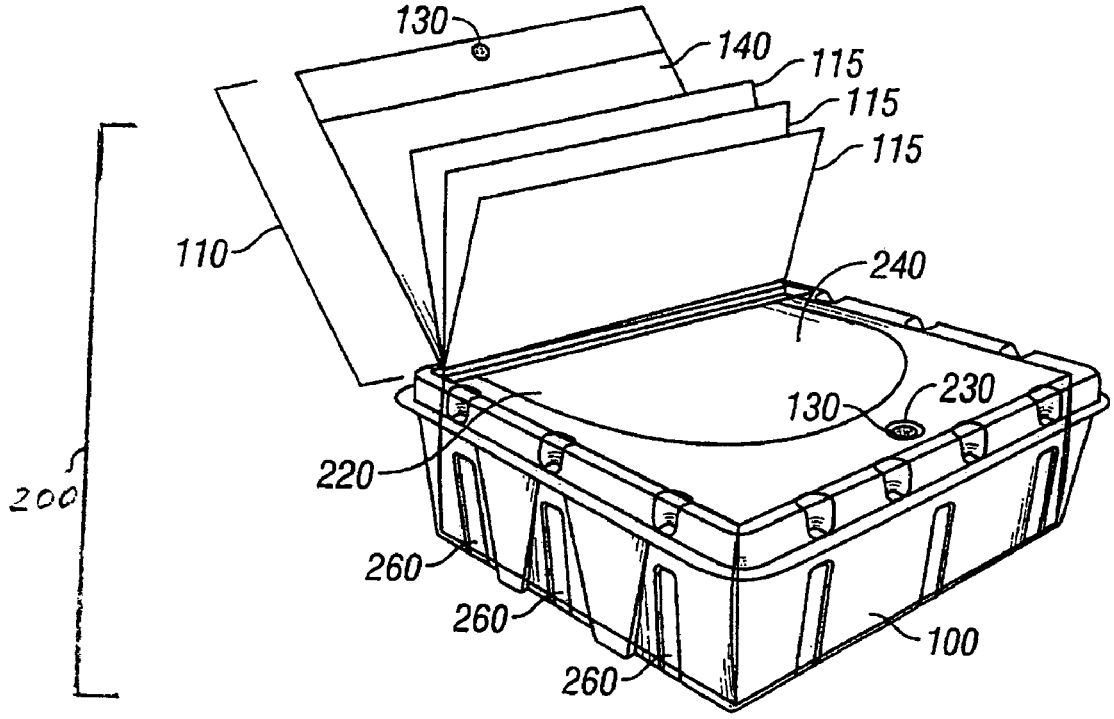

FIGS. 4A and 4B show the assembled display enclosure 200, here with the cover 110 open to allow viewing of the inside surface 140. Again, as shown in FIGS. 4A and 4B, the aperture 240 is shaped in such a way as to allow the cover 110 and the inside pages 115 to fit through and at the same time to prevent the product box from being removed from the display enclosure 200 through the aperture 240. The inside pages 115 can take various shapes. For example, in FIG. 4A, the inside pages 115 are of the same semicircular shape as the aperture 240, but slightly smaller. In FIG. 4B, however, the shape of the inside pages 115 is different from the shape of the aperture 240. Thus, the inside pages 115 in FIG. 4B have a rectangular shape. Again, it can be seen that but for the portion of the box exposed through the slot 240, the product box 100 is substantially enclosed within the display enclosure 200, and thus protected against tampering or opening to remove the CD-ROM.

Figure 5A:
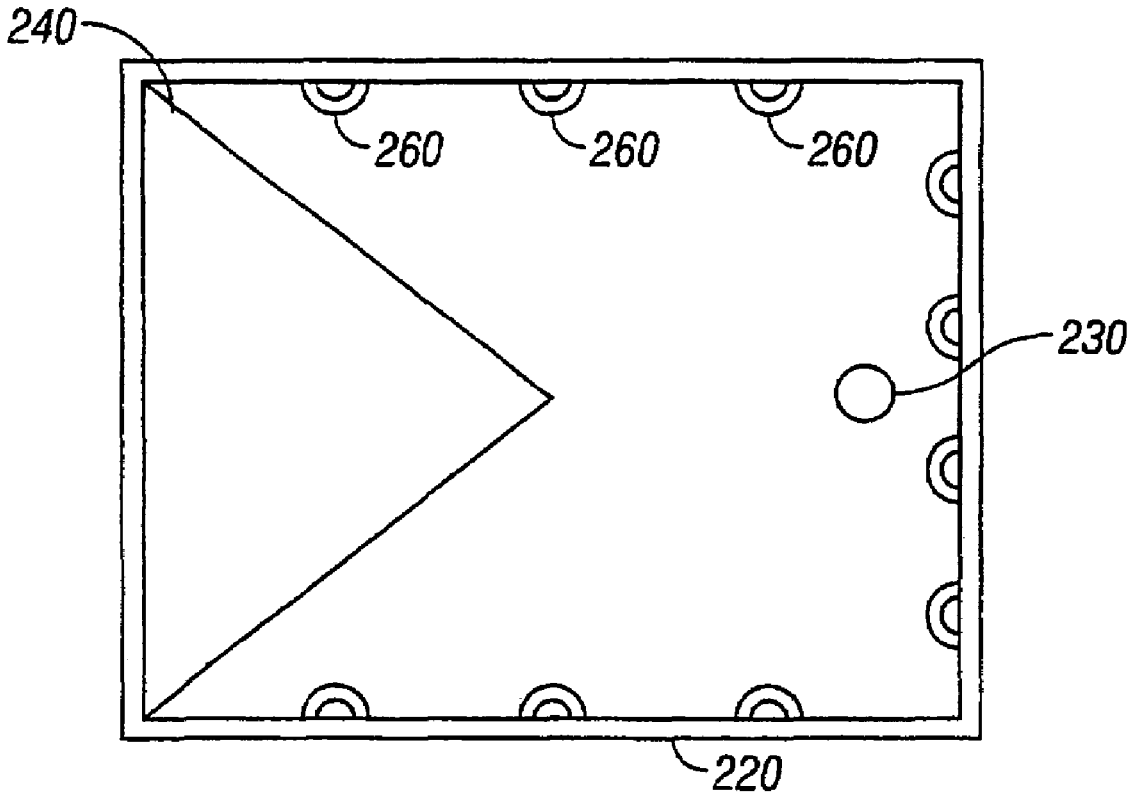
FIGS. 5A–5D show different shapes of the aperture of the lid of the display enclosure.
Figure 5B:
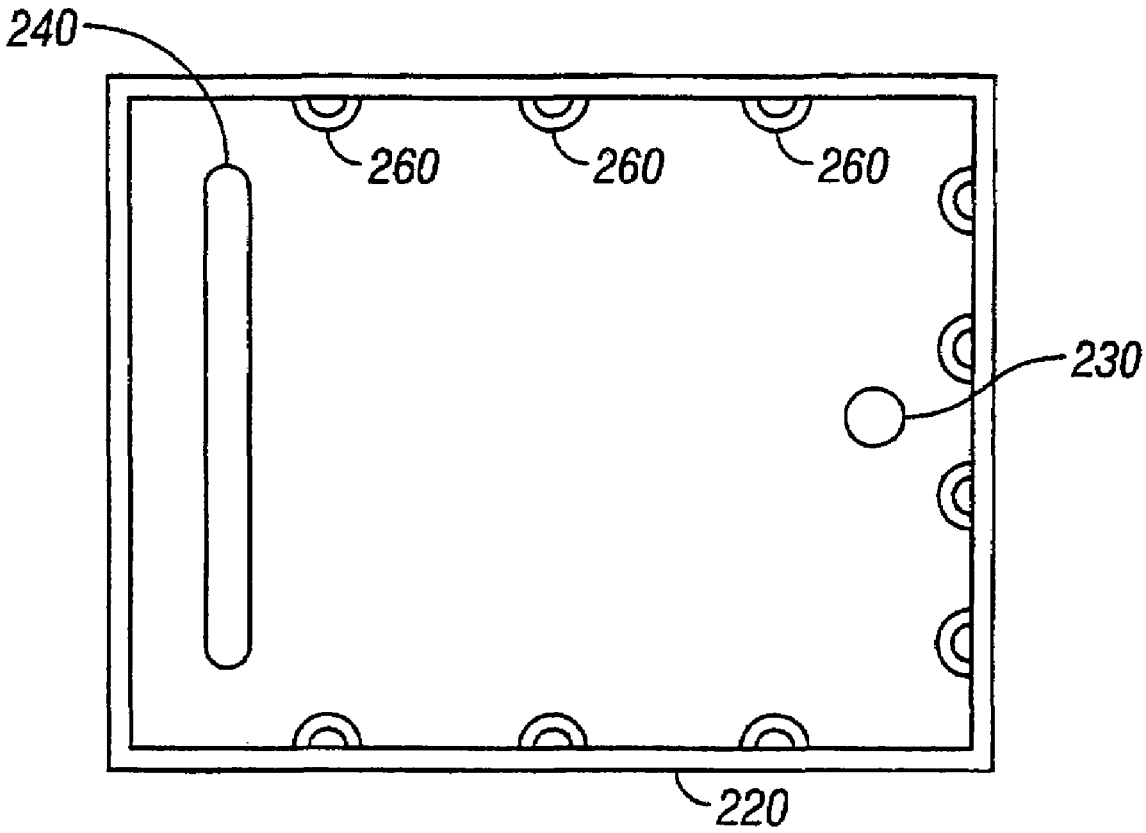
Figure 5C:
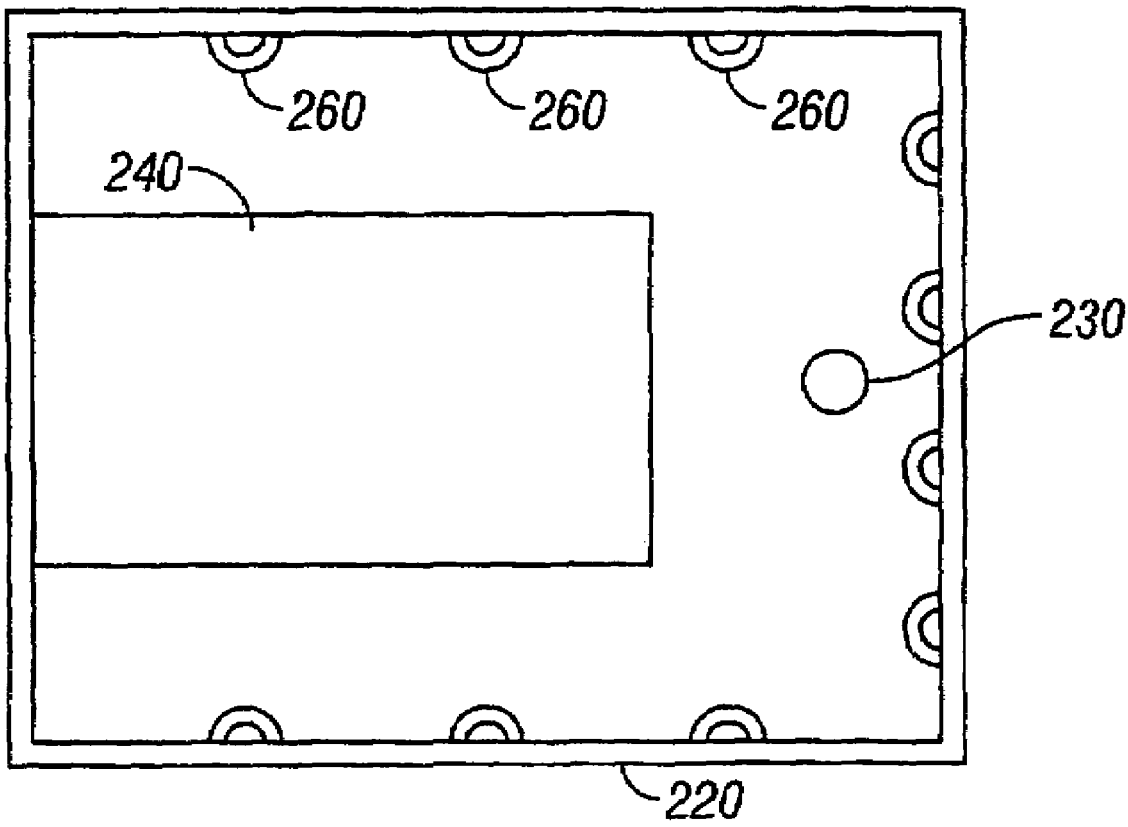
Figure 5D:
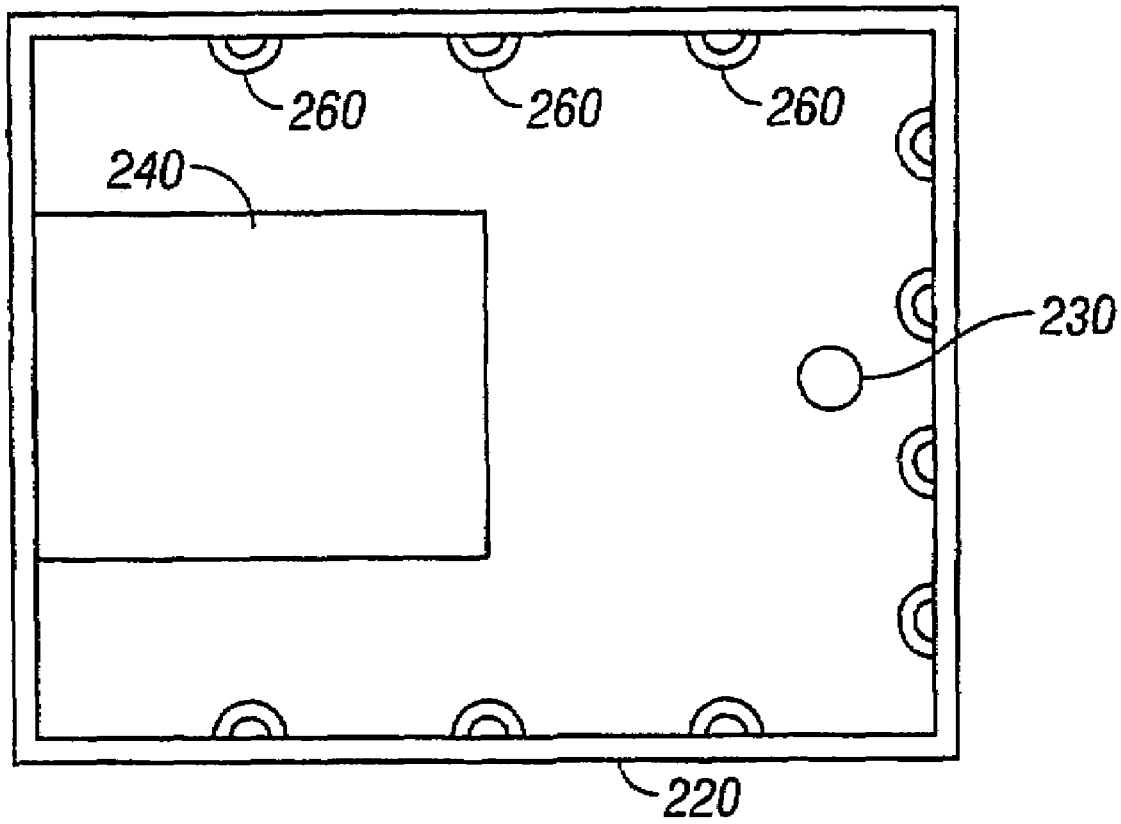
Figure 6:
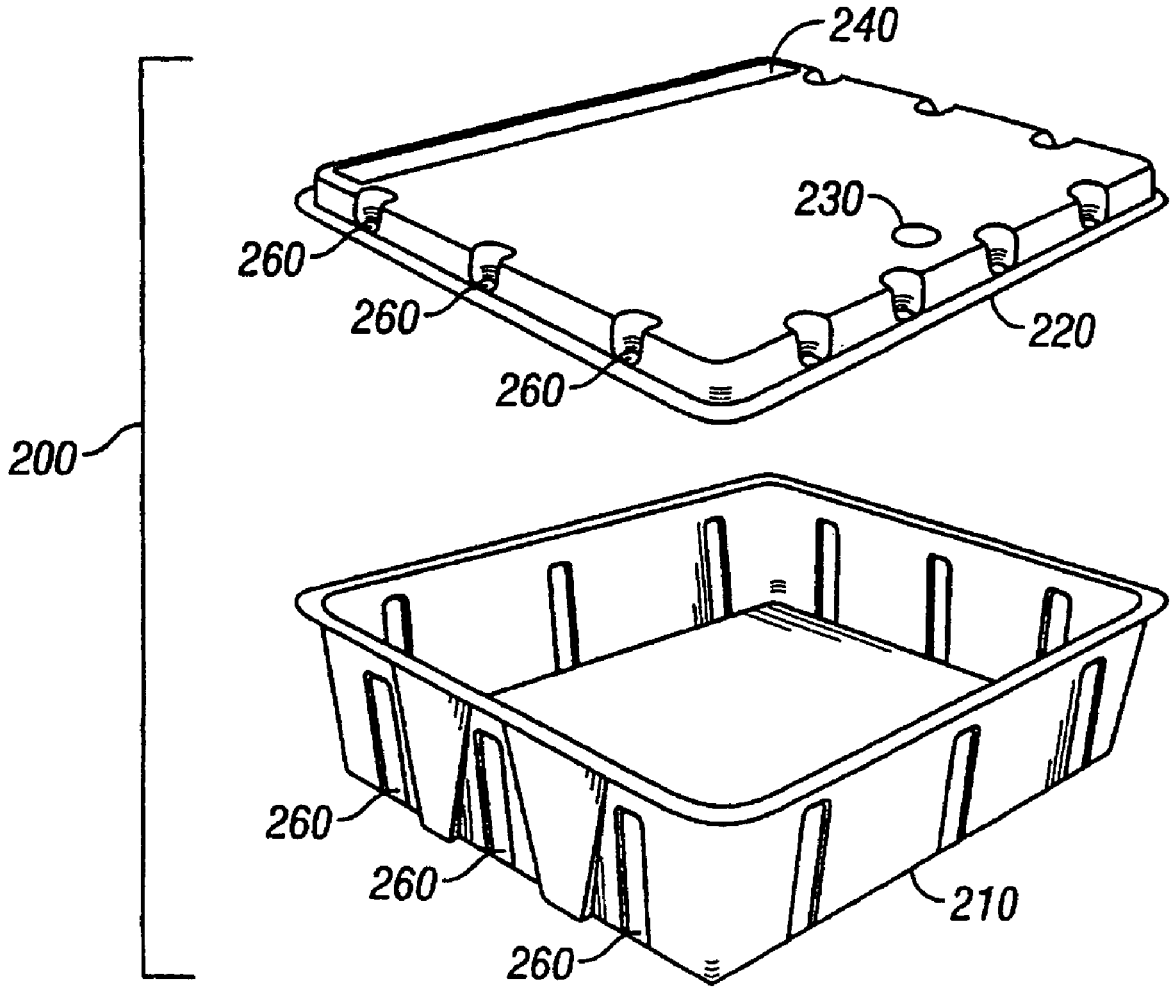
FIG. 6 shows an exploded, perspective view of a display enclosure in accordance with another embodiment of the invention.

FIGS. 5A–5D show top views of the lid 220 of the display enclosure 200 having various shapes of the aperture 240. In FIG. 5A, the aperture 240 has a triangular shape. In FIG. 5B, the aperture 240 is shaped as a slot running along a substantial portion of the left edge of the lid 220. In FIG. 5C, the aperture 240 is shaped as a rectangular with a wide aspect ratio. In FIG. 5D, the aperture 240 is also shaped as a rectangular, but with a narrow aspect ratio. As previously described, the inside pages 115, such as the ones shown in FIGS. 3–4B, may be of the same shape as the aperture 240 or may have a shape different from the shape of the aperture 240. As shown in FIGS. 5A–5D, the lid 220 also has the opening 230 that allows the cover 110 of the product box, such as the one shown in FIGS. 1 and 2 to remain closed after the box 100 is sealed within the display enclosure 200.

FIG. 6 shows an alternative embodiment of the display enclosure 200 in which the aperture 240 is shaped as a slot running along the hinged edge of the top surface of the lid 220. The slot 240 is shaped in such a way as to allow the cover 110 (such as the one shown in FIG. 1) to pass through and extend outside of the display enclosure 200, without permitting the product box to be extracted through the slot 204. For example, the slot 240 shown in FIG. 6 could be just longer than the length of the cover 110 and display pages 115 (shown in FIG. 1), and only just wide enough to allow the cover 110 and display pages 115 to fit through.

Figure 7:
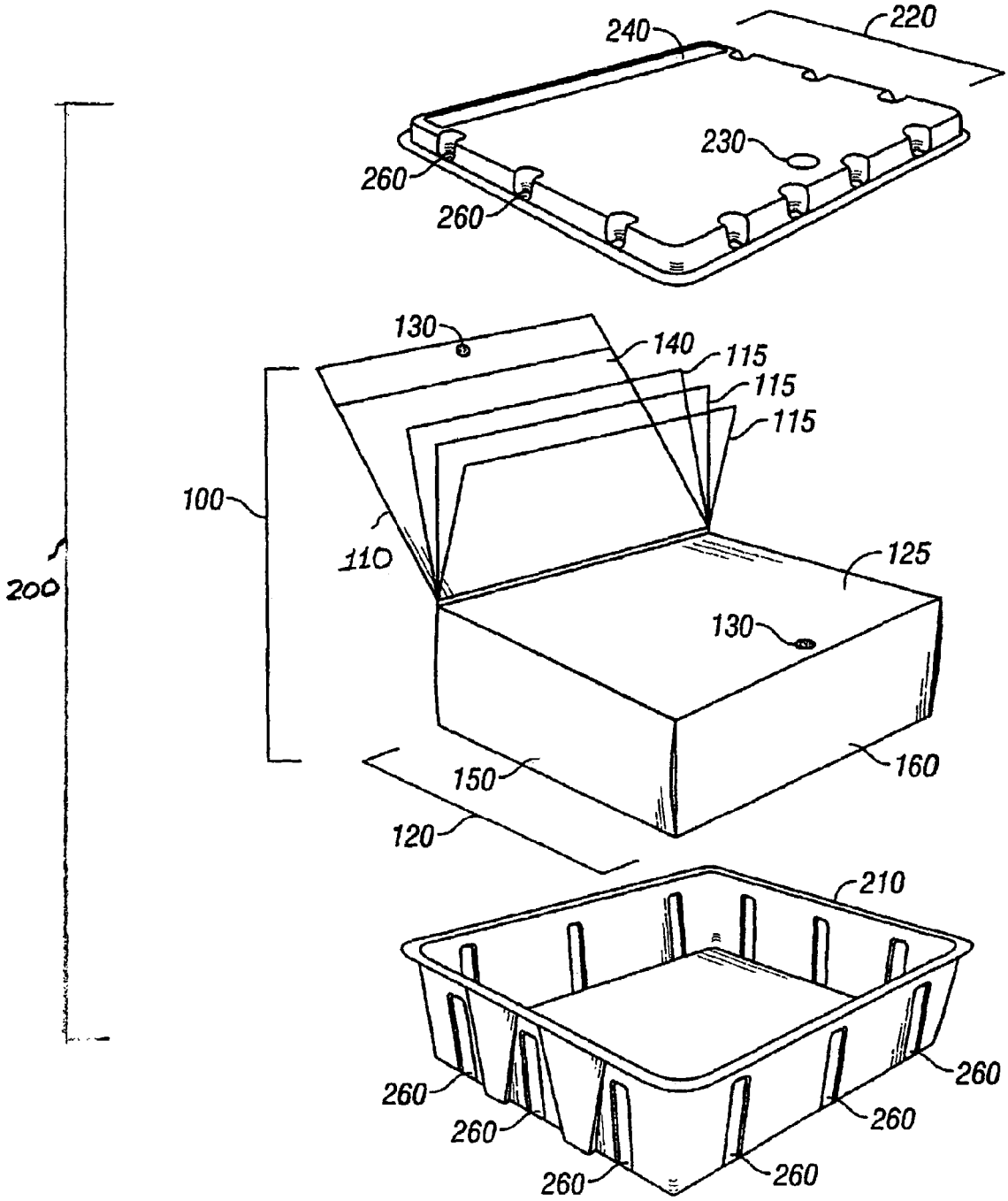
FIG. 7 shows an exploded, assembly view showing the lid and base of the display enclosure of FIG. 6 in conjunction with a product box.

FIG. 7 shows an exploded, assembly view of the display enclosure 200 of FIG. 6 in which the aperture 240 is shaped as a slot. The display enclosure 200 is shown in conjunction with the product box 100. To assemble the display enclosure 200, the body section 120 of the box 100 is placed within the base 210. Then, the lid 220 is placed onto the base 210 so that the cover 110 and preferably the inside pages 115 pass through the slot 240 and extend outside of the display enclosure 200.

Figure 8:
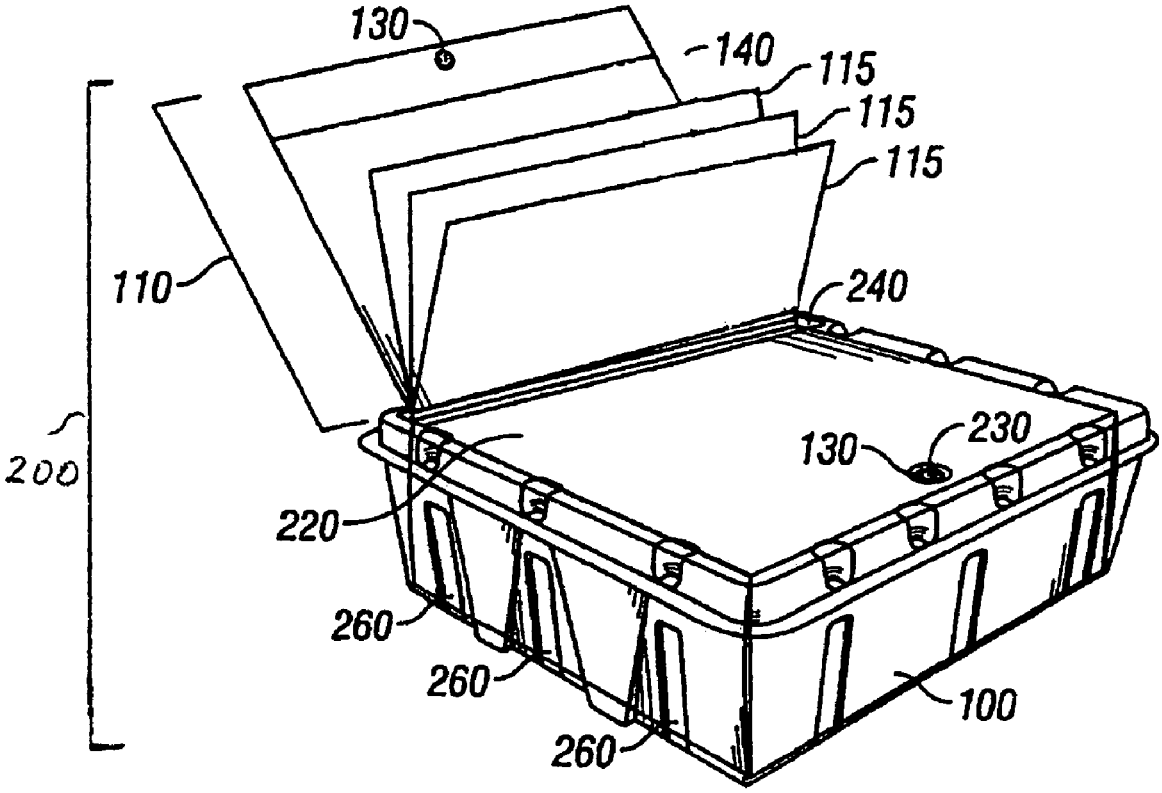
FIG. 8 shows the assembled display enclosure of FIG. 6 containing a product box with its cover opened.

FIG. 8 shows the assembled display enclosure 200 of FIG. 6 in which the aperture 240 is shaped as a slot. The inside pages 115 pass through the slot 240 and extend outside of the display enclosure 200. The product box 100 is substantially enclosed within the display enclosure but for the portion of the box exposed through the slot 240.

FIGS. 2–8 illustrate various views of the display enclosure 200 in which can be seen multiple indentations 260 on the surfaces of the display enclosure 200. Those of skill in the art of thermoforming and clamshell design appreciate that these surface features are generally artifacts of the molding process, thereby arbitrary in shape and location. Accordingly, they are not necessary features of the present invention or its embodiments.

While the present invention was described in connection with preferred embodiments thereof, it will be understood that it is not intended to limit the invention to those embodiments. On the contrary, it is intended to cover all the alternatives, modifications, and equivalents as may be included within the spirit and scope of the invention as defined by the appended claims.

We claim:

1. A product display device comprising:

a product box having a body section and a cover, the cover movably attached to the body section; and a display enclosure adapted to substantially enclose the product box, the display enclosure having a lid with an aperture, the aperture adapted to allow the cover to extend there through and to at least partially close over the lid of the display enclosure with the product box enclosed within the display enclosure, the aperture sized to prevent the product box from being removed from the display enclosure through the aperture.

2. The product display device of claim 1, wherein the product box includes pages between the cover and a top surface of the product box, wherein the pages extend through the aperture of the lid of the display enclosure.

3. The product display device of claim 2, wherein the pages extending through the aperture of the lid are of the same shape as the aperture.

4. The product display device of claim 2, wherein the pages extending through the aperture of the lid have a shape different from the shape of the aperture.

5. The product display device of claim 1, wherein the lid of the display enclosure includes an opening through which a first connector affixed to the cover of the product box can detachably connect to a second connector affixed to a top surface of the product box.

6. The product display device of claim 1, wherein the display enclosure is transparent.

7. The product display device of claim 1, wherein the aperture has a slot shape.

8. The product display device of claim 1, wherein the aperture has a triangular shape.

9. The product display device of claim 1, wherein the aperture has a rectangular shape.

10. The product display device of claim 1, wherein the aperture has a semicircular shape.

11. A method for assembling a display enclosure having a base and a lid with an aperture, the method comprising:

placing a product box having a body section and a cover into the base of the display enclosure;

placing the lid onto the base so that the cover of the product box is fitted through the aperture of the lid and extends outside of the display enclosure so that to at least partially close over the lid of the display enclosure; and sealing the lid and the base around the body section of the box along edges of the base, thereby substantially enclosing the product box within the display enclosure, so that the product box cannot be removed from the display enclosure through the aperture.

12. The method of claim 11, wherein the product box includes pages between the cover and a top surface of the product box and wherein the method further comprises:

passing the pages through the aperture of the lid before sealing the lid and the base around the body section of the box.

13. A product display device comprising:

a product box having a body section and a cover, the cover movably attached to the body section; and a display enclosure adapted to substantially enclose the product box, the display enclosure having a lid with a slot the slot adapted to allow the cover to extend there through and to at least partially close over the lid of the display enclosure with the product box enclosed within the display enclosure, the slot sized to prevent the product box from being removed from the display enclosure through the slot.

14. The product display device of claim 13, wherein the product box includes pages between the cover and a top surface of the product box, wherein the pages extend through the slot of the lid of the display enclosure.

15. The product display device of claim 13, wherein the lid of the display enclosure includes an opening through which a first connector affixed to the cover of the product box can detachably connect to a second connector affixed to a top surface of the product box.

16. The product display device of claim 13, wherein the display enclosure is transparent.

* * * * *

UNITED STATES PATENT AND TRADEMARK OFFICE

CERTIFICATE OF CORRECTION

PATENT NO. : 6,997,324 B2
DATED : February 14, 2006
INVENTOR(S) : Sanford Hirschel It is certified that error appears in the above-identified patent and that said Letters Patent is hereby corrected as shown below:

Column 6,
Line 39, insert -- , -- (comma) between “slot” and “the slot”.

Signed and Sealed this

Twenty-third Day of May, 2006

JON W. DUDAS
*Director of the United States Patent and Trademark Office*